US007926770B2

(12) United States Patent
Bonshor

(10) Patent No.: US 7,926,770 B2
(45) Date of Patent: Apr. 19, 2011

(54) MULTIDIRECTIONAL MOUNTING BRACKET ASSEMBLY FOR EXTERIOR SIDING

(75) Inventor: David Bonshor, Surrey (CA)

(73) Assignee: Tapco International Corporation, Wixom, MI (US)

( * ) Notice: Subject to any disclaimer, the term of this patent is extended or adjusted under 35 U.S.C. 154(b) by 1128 days.

(21) Appl. No.: 11/623,916

(22) Filed: Jan. 17, 2007

(65) Prior Publication Data

US 2007/0175168 A1 Aug. 2, 2007

Related U.S. Application Data

(60) Provisional application No. 60/759,651, filed on Jan. 17, 2006.

(51) Int. Cl.
*A47F 5/08* (2006.01)

(52) U.S. Cl. ..... 248/205.1; 248/906; 52/60; 52/97; 174/67; 454/275; 454/276

(58) Field of Classification Search ..... 52/60, 61, 52/97, 204.54, 209, 220.8, 302.1, 199, 212, 52/473, 716.2, 208, 217; 248/205.1, 906; 174/67, 58, 66; 454/275–277; 220/241, 220/242

See application file for complete search history.

(56) References Cited

U.S. PATENT DOCUMENTS

| | | | |
|---|---|---|---|
| 2,777,405 | A | 1/1957 | Ager |
| 4,112,691 | A | 9/1978 | Ebeling et al. |
| 4,381,063 | A | 4/1983 | Leong |
| 4,391,068 | A | 7/1983 | Kosar |
| 4,646,488 | A | 3/1987 | Burns |
| 4,726,152 | A | 2/1988 | Vagedes et al. |
| 4,875,318 | A | 10/1989 | MacLeod et al. |
| 4,920,708 | A | 5/1990 | MacLeod et al. |
| 4,956,948 | A | 9/1990 | Hart |
| 5,000,409 | A | 3/1991 | MacLeod et al. |
| 5,018,333 | A | 5/1991 | Bruhm |
| 5,133,165 | A | 7/1992 | Wimberly |
| 5,303,522 | A | 4/1994 | Vagedes |
| 5,326,060 | A | 7/1994 | Chubb et al. |
| 5,369,922 | A | 12/1994 | Hansen |
| 5,397,093 | A | 3/1995 | Chubb et al. |
| 5,526,619 | A | 6/1996 | Vagedes |
| 5,549,266 | A | 8/1996 | Mitchell et al. |
| 5,594,206 | A | 1/1997 | Klas et al. |

(Continued)

OTHER PUBLICATIONS

Nurenberg et al., U.S. Appl. No. 12/147,305, filed Jun. 27, 2008, 56 pages.

(Continued)

*Primary Examiner* — Brian E Glessner
*Assistant Examiner* — James J Buckle, Jr.
(74) *Attorney, Agent, or Firm* — Howard & Howard Attorneys PLLC

(57) ABSTRACT

A multidirectional mounting bracket assembly is utilized in conjunction with exterior siding that covers sheathing of an exterior wall. The assembly has trim member that press fits to a base member along an axis disposed perpendicular to the exterior wall. The base member has a mounting flange secured to the sheathing and circumferentially continuous inner and outer walls disposed co-axially to one another and laterally projecting axially. The trim member has a facial plate disposed substantially perpendicular to the axis and a mating wall that press fits between the inner and outer walls. The outer wall carries a plurality of channeling features for cascading water on top of the mating wall. The mating wall generally carries a dam flange and preferably end dams for diverting water through weep holes in the facial plate.

19 Claims, 5 Drawing Sheets

U.S. PATENT DOCUMENTS

| | | | |
|---|---|---|---|
| 5,675,940 | A | 10/1997 | Bahar et al. |
| 5,722,208 | A | 3/1998 | Humphrey et al. |
| 5,918,431 | A | 7/1999 | Schiedegger et al. |
| 6,070,375 | A | 6/2000 | Anderson et al. |
| 6,076,310 | A | 6/2000 | Kim |
| 6,098,343 | A | 8/2000 | Brown et al. |
| 6,119,416 | A | 9/2000 | Larson |
| 6,151,838 | A | 11/2000 | Husein |
| 6,155,008 | A | 12/2000 | McKee |
| 6,429,371 | B2 | 8/2002 | Schiedegger et al. |
| 6,553,735 | B1 | 4/2003 | Chen |
| D475,440 | S | 6/2003 | Sawyer |
| 6,610,927 | B2 | 8/2003 | Dinh et al. |
| 6,780,100 | B1 | 8/2004 | Gretz |
| 6,825,414 | B2 | 11/2004 | Vagedes |
| 6,904,725 | B1 | 6/2005 | Hansen et al. |
| 6,951,081 | B2 | 10/2005 | Bonshor |
| RE38,881 | E | 11/2005 | Chubb et al. |
| 7,096,627 | B2 | 8/2006 | Wade |
| 7,107,736 | B2 | 9/2006 | Barnard |
| 7,408,111 | B2 | 8/2008 | Clark et al. |
| 7,610,726 | B2 | 11/2009 | Lajewski |
| 2001/0015281 | A1 | 8/2001 | Schiedegger et al. |
| 2003/0041539 | A1 | 3/2003 | Bernacki et al. |
| 2003/0136060 | A1 | 7/2003 | Bonshor |
| 2003/0177725 | A1 | 9/2003 | Gatherum |
| 2006/0213132 | A1 | 9/2006 | Bonshor |
| 2006/0260216 | A1 | 11/2006 | Bonshor |
| 2006/0261636 | A1 | 11/2006 | Bonshor |
| 2006/0277857 | A1 | 12/2006 | Bonshor |
| 2007/0044393 | A1 | 3/2007 | Bonshor |
| 2007/0044401 | A1 | 3/2007 | Bonshor |
| 2007/0175168 | A1 | 8/2007 | Bonshor |
| 2008/0149792 | A1 | 6/2008 | Nurenberg et al. |

OTHER PUBLICATIONS

Bonshor, U.S. Appl. No. 12/390,154, filed Feb. 20, 2009, 12 pages.

MULTIDIRECTIONAL MOUNTING BRACKET ASSEMBLY FOR EXTERIOR SIDING

CROSS-REFERENCE TO RELATED APPLICATION

The instant application claims priority to U.S. Provisional Patent Application Ser. No. 60/759,651, filed Jan. 17, 2006, the entire specification of which is expressly incorporated herein by reference.

TECHNICAL FIELD

The present invention relates generally to an exterior siding mounting bracket assembly and more particularly to a multidirectional mounting bracket assembly.

BACKGROUND OF THE INVENTION

Common in residential building structures, sheathing of an exterior wall is known to be covered with a siding material typically made of cedar, aluminum, plastic or other synthetic material often made to appear like wood. Often, various exterior appendages of the home such as cloths dryer vents, exterior light fixtures, electrical outlets, and water spigots must be trimmed-out around the siding for aesthetic reasons. This is commonly done with a mounting bracket. One such example of a known mounting bracket is taught in U.S. Pat. No. 4,920,708, assigned to the same assignee as the present invention and incorporated herein by reference in its entirety. The known mounting bracket has an internal base member that snap fits to an external trim member along an axis disposed perpendicular to the sheathing and during assembly. The base member has a continuous flange that projects radially outward and is typically nailed to the sheathing under the siding. Projecting axially or laterally outward from the flange and to an inner central panel is a continuous wall. Generally, the wall defines the perimeter of the central panel. A cutout communicates through the panel and has a shape generally dictated by the appendage projecting through it.

The trim member typically has a partition that projects laterally and axially inward toward the base member, and an aesthetically pleasing and continuous flange that projects radially outward from the partition. An opening is generally defined by the partition and receives the wall and central panel when the bracket is assembled. The partition is generally shaped to conform with the wall. Multi-positional snap fit features are known to be carried between a radially outward surface of the wall and a radially inward surface of the partition. When the bracket is assembled, the close proximity of the partition to the wall causes the feature to lock the partition and wall together.

During construction of the building, once the base member is secured to the wall or sheathing, the siding material is installed over the sheathing and over the flange. The siding, however, must be trimmed so that it is slightly spaced from the continuous wall of the base member. This spacing allows room for entry of the continuous partition of the trim piece, yet is close enough to the wall of the bracket so that the ends are aesthetically concealed by the outer flange of the trim member which is substantially flush to the siding. Unfortunately, the siding is typically exposed to rain or water which flows down the siding and beneath the exterior flange. This water can accumulate and seep beneath the concealed ends of the siding and against the mounting flange of the base member. Accumulation of water directly against the mounting flange can cause water propagation outward from the wall of the base member and beyond the mounting flange, thus exposing the sheathing to moisture. The retained moisture can potentially create a host of problems including the rot of wood, disintegration of simulated materials and the attraction of unwanted insects.

To reduce or eliminate this water seepage, various bracket assemblies are known to be self-flashing for diverting water run-off away from the sheathing. One such bracket is taught in U.S. Pat. No. 6,951,081, issued on Oct. 4, 2005 and incorporated herein by reference in its entirety.

Unfortunately, known self-flashing bracket assemblies can be mounted in one position only. Particularly, oblong or rectangular bracket assemblies must be separately manufactured with distinct features for horizontal and vertical orientations. This requires separate manufacturing molds/tooling and can complicate shipping and stocking of the product. This further requires that a siding installer must buy two separate mounting blocks depending upon whether he wants to install the rectangular bracket assembly horizontally or vertically.

SUMMARY OF THE INVENTION AND ADVANTAGES

A multidirectional mounting bracket assembly is utilized in conjunction with exterior siding that covers sheathing of an exterior wall. The assembly has trim member that press fits to a base member along an axis disposed perpendicular to the exterior wall. The base member has a mounting flange secured to the sheathing and circumferentially continuous inner and outer walls disposed co-axially to one another and laterally projecting axially. The trim member has a facial plate disposed substantially perpendicular to the axis and a mating wall that press fits between the inner and outer walls. The outer wall carries a plurality of channeling features for cascading water on top of the mating wall. The mating wall generally carries a dam flange and preferably end dams for diverting water through selected weep holes in the facial plate.

Features, advantages and benefits of the present invention include a mounting bracket assembly having an irregular or rectangular shape that can be selectively mounted in at least two positions without degrading the assemblies self-flashing and water shedding capability. Other advantages include improved water shedding capabilities that eliminates or reduces exposure of the sheathing to moisture that could cause damage to structural material and potentially attract unwanted insects. The assembly reduces or eliminates of structural maintenance, has a design that is relatively simple, robust and versatile, and is inexpensive to manufacture and easy to install.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENTS

Figure 1:
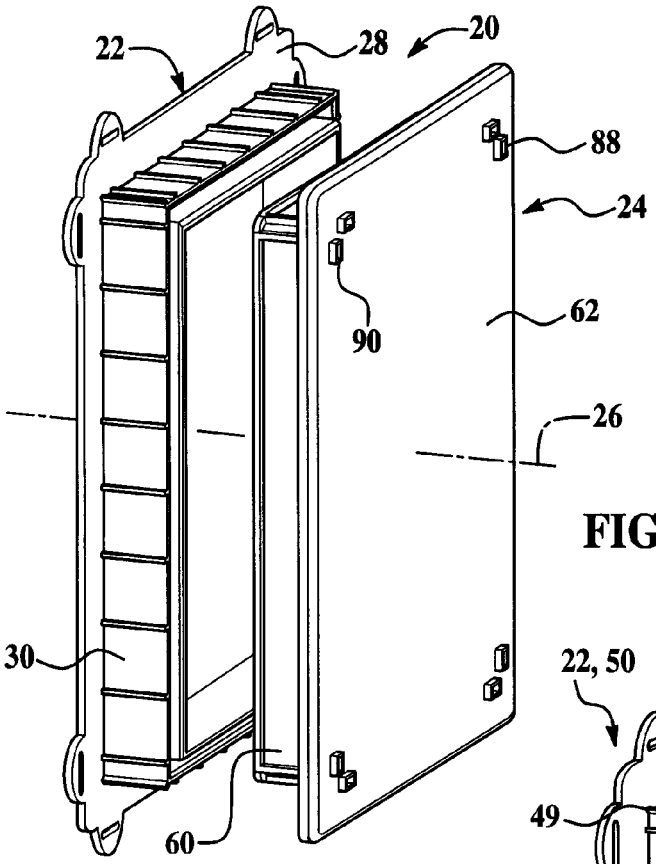
FIG. 1 is an exploded perspective view of a multidirectional mounting bracket assembly embodying the present invention.
Figure 10:
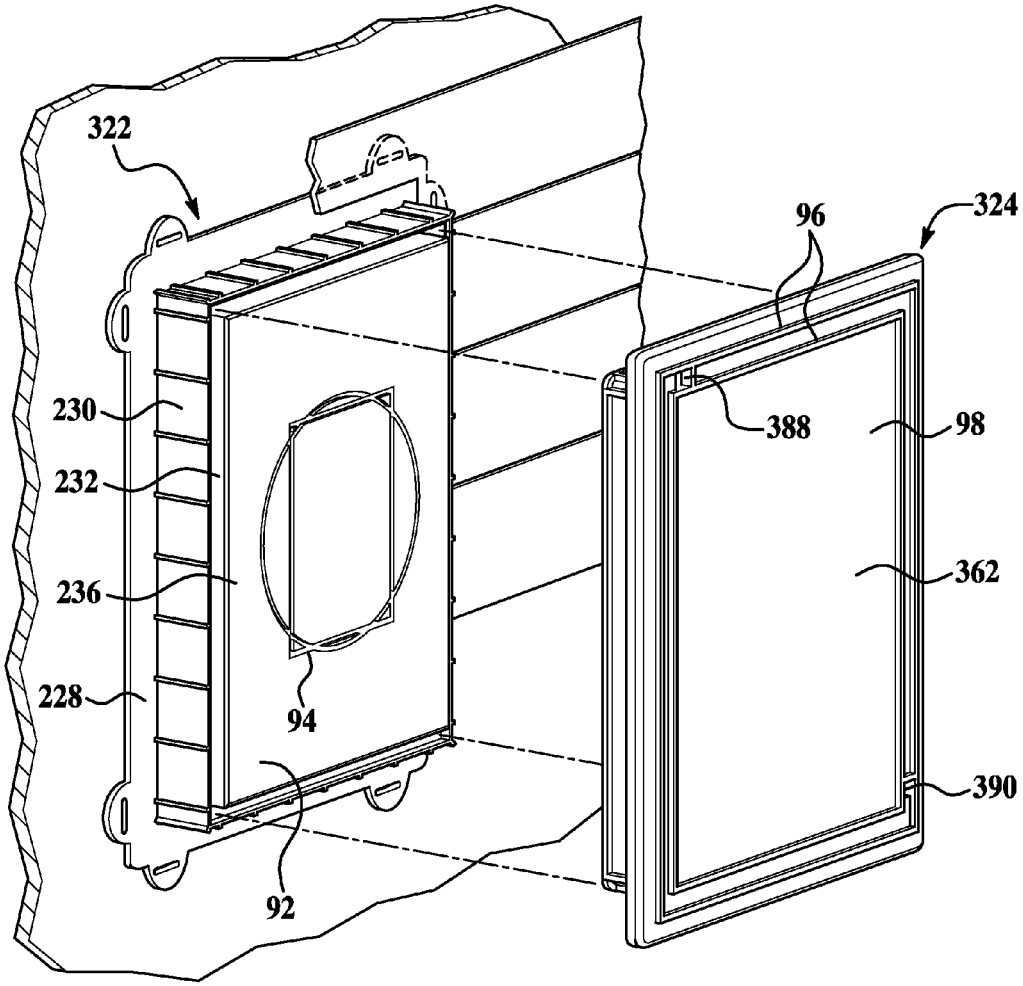
FIG. 10 is a cut-away perspective view of the third embodiment of the multidirectional mounting bracket assembly installed on a substantially vertical substructure of a sided exterior wall.

As best illustrated in FIG. 1, a multidirectional mounting bracket assembly 20 embodying the present invention generally projects or is exposed through exterior siding (shown in FIG. 10) of a substantially vertical wall of any variety of buildings or residential structures exposed to inclement weather such as rain and generally water runoff. The assembly 20 provides an aesthetically pleasing surface that any variety of exterior components can be easily mounted to or project from. Such components include but are not limited to hose spigots, electrical receptacles, clothes dryer vents, and light fixtures.

The assembly 20 as illustrated is rectangular in shape having four sides. This shape however may have any number of sides and may thus be any number of shapes including, for example, a triangle or hexagon. The assembly 20 is self-flashing for the prevention of water seepage beneath the siding, and has a base member 22 and a trim member 24 that preferably snap fits to the base member generally along an axis 26. The base member 22 fastens to a substructure (shown in FIG. 10) of the exterior wall preferably prior to placement of the siding. The substructure is generally an underlayment or sheathing that is covered by the siding material, and orientated substantially perpendicular to the axis 26. Preferably, the base member 22 and the trim member 24 are made of injection molded plastic or fiberglass.

Figure 2:
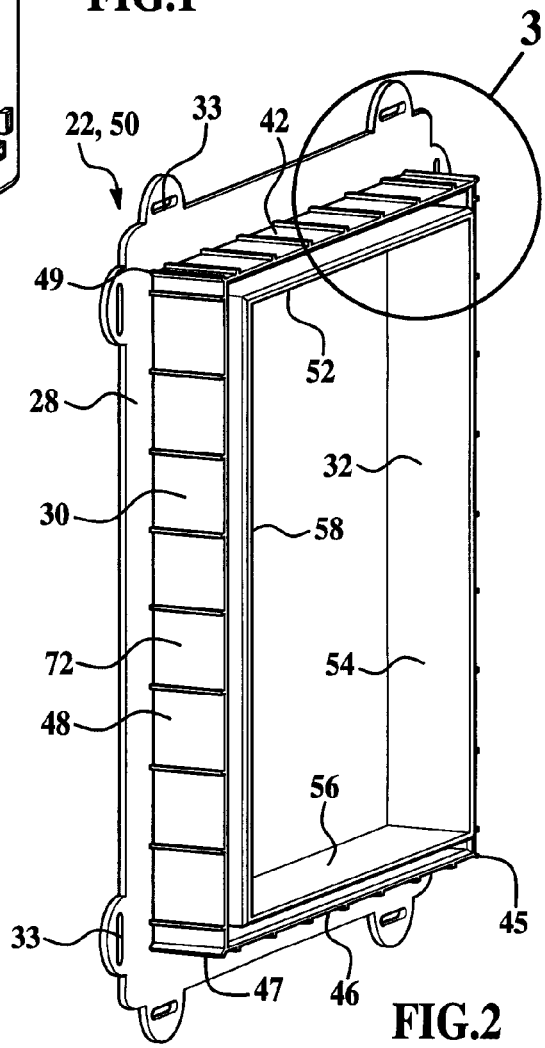
FIG. 2 is a perspective view of a base member of the multidirectional mounting bracket assembly.
Figure 3:
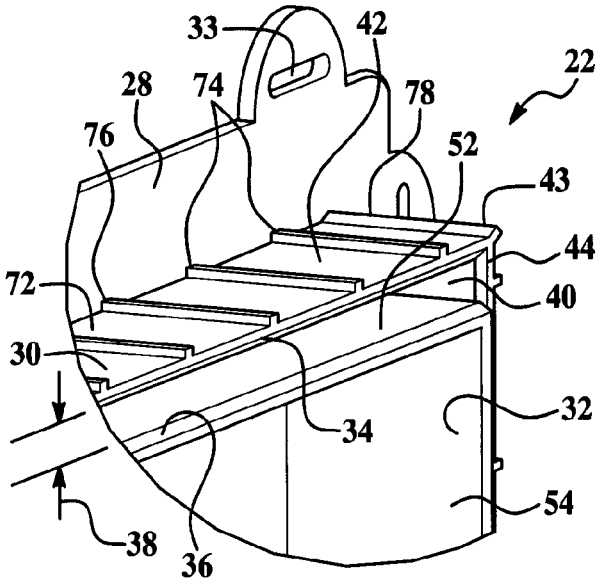
FIG. 3 is an enlarged partial view of the base member taken from circle 3 of FIG. 2.

Referring to FIGS. 2 and 3, the base member 22 has a mounting flange 28, a continuous outer wall 30, and a continuous inner wall 32. Preferably, the flange 28 and inner and outer walls 30, 32 continuously extend circumferentially about axis 26. Also with respect to axis 26, the flange 28 projects radially outward from the inner wall 32 and connecting to and extending radially beyond the outer wall 30. When installed, the flange 28 seats flat against the sheathing and is secured to the sheathing via nails or screws inserted through a plurality of holes 33. The walls 30, 32 project co-axially and laterally outward from the flange 28 to respective continuous edges 34, 36 that are tapered for easy axial receipt of the trim member 24. The outer wall 30 is generally spaced radially outward from the inner wall 32 by a distance 38, and the inner wall 32 projects axially outward further than the outer wall 30, thus positioning the distal edge 36 of the inner wall 32 to function as a stop when the trim member 24 is press fitted to the base member 22. An annular cavity 40 in the base member 22 opens axially outward and is defined by the outer and inner walls 30, 32 and a radially inward portion of the flange 28.

Preferably the outer wall 30 of the base member 22 has a substantially planar first section 42, a second section 44, a third section 46 and a fourth section 48. When the assembly 20 is in a vertical position 50 (i.e. the second and fourth sections 44, 48 are longer than the first and third sections 42, 46) and as illustrated in FIG. 2, the second and fourth sections 44, 48 are substantially vertical, thus being right and left sections, respectively. Each section 42, 44, 46, 48 is contiguous to the next adjacent section forming respective corners 43, 45, 47, 49. Similarly, the first and third sections 42, 46 are substantially horizontal, thus being top and bottom sections, respectively. The inner wall 32 has substantially planar first, second, third and fourth segments 52, 54, 56, 58 that are substantially parallel to and equally spaced from the respective sections 42, 44, 46, 48.

Figure 4:
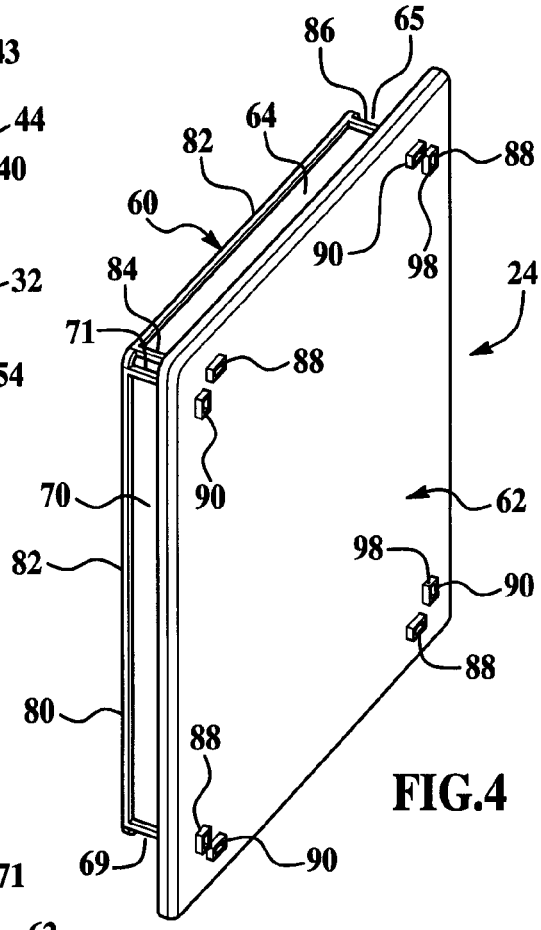
FIG. 4 is a front perspective view of a trim member of the multidirectional mounting bracket assembly.
Figure 5:
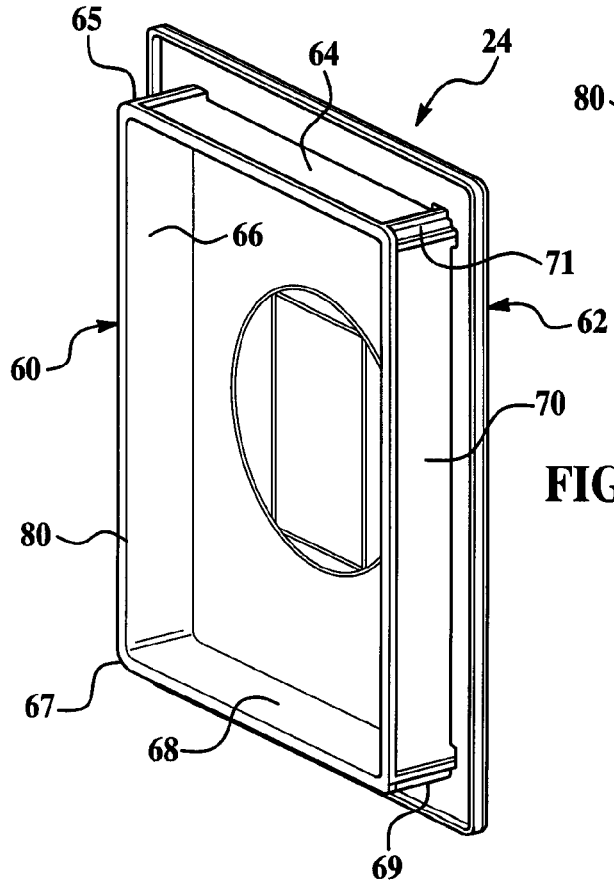
FIG. 5 is a rear perspective view of the trim member.
Figure 6:
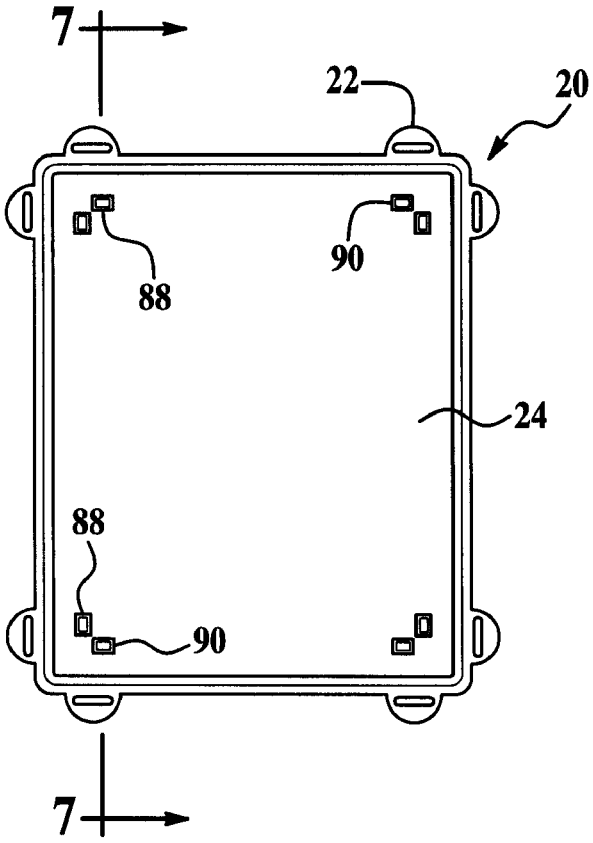
FIG. 6 is a front view of the multidirectional mounting bracket assembly.
Figure 7:
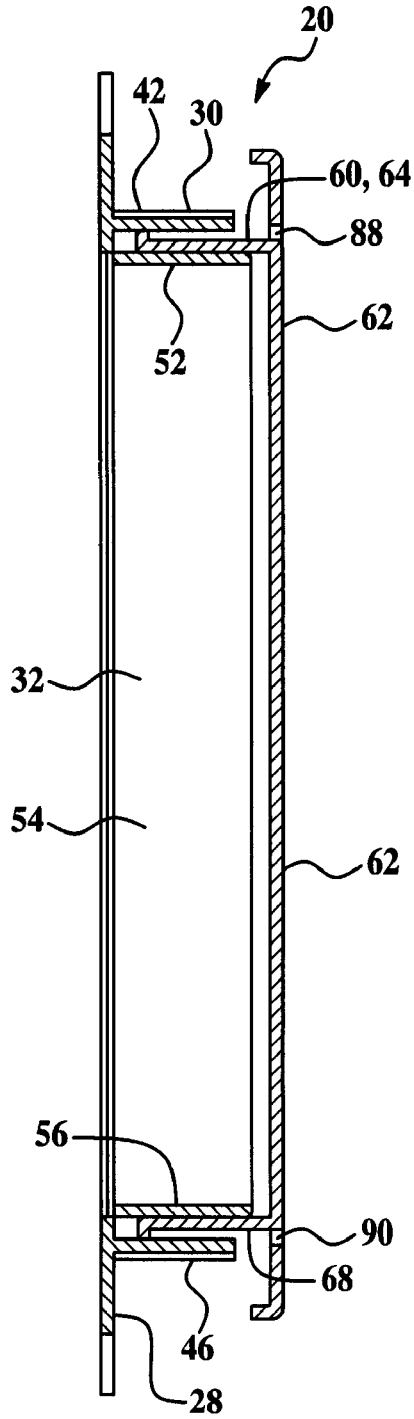
FIG. 7 is a cross section of the multidirectional mounting bracket assembly taken along line 7-7 of FIG. 6.

Referring to FIGS. 4 and 5, the trim member 24 has a preferably circumferentially continuous mating wall 60 that press fits radially between the inner and outer walls 32, 30 for locating in the annular cavity 40, and a facial plate 62. When the assembly 20 is assembled, the facial plate 62 is substantially perpendicular to the axis 26 and spans radially outward and beyond the outer wall 30 of the base member 22. The mating wall 60 laterally projects axially inward and generally toward the flange 28 of the base member 22 for location in the cavity 40, and the stop edge 36 of the inner wall 32 is generally in contact with the back of the facial plate 62. Preferably the mating wall 60 of the trim member 24 has a substantially planar first segment 64, a second segment 66, a third segment 68 and a fourth segment 70. Each segment 64, 66, 68, 70 is contiguous to the next adjacent segment forming respective corners 65, 67, 69, 71.

Referring to FIGS. 1-7, when the assembly 20 is fully assembled, the base and trim members 22, 24 have various features that channel water generally away from the base flange 28 of the base member 22 and the siding (not shown), and through the facial plate 62 of the trim member 24. To accomplish this and as best shown in FIG. 3, the outer wall 30 of the base member 22 has a face 72 that faces radially outward. This face 72 is carried by each one of the plurality of planar sections 42, 44, 46, 48 of the outer wall 30. Carried or defined by the outer face 72 at each planar section 42, 44, 46, 48 are a plurality of channeling features 74 that divert water. The channeling features 74 are preferably ribs, but may also be grooves in the wall 30 or any other type of feature capable of channeling water. Each rib 74 longitudinally extends axially and laterally projects radially outward. The ribs 74 are generally aligned axially with respect to axis 26 and laterally spaced circumferentially away from one another. Preferably, the plurality of ribs 74 for each respective section 42, 44, 46, 48 have a series of mid ribs 76 and a corner rib or apex 78 projecting from the respective corners 43, 45, 47, 49.

The channeling features 74 and generally those located on the first or top section 42 direct any water over the distal edge 34 of the outer wall 30 and cascade the water downward and upon the first segment 64 of the mating wall 60 of the trim member 24. The continuous mating wall 60 laterally projects axially inward with respect to axis 26 and to a continuous distal edge 80 of the wall. A dam flange 82 of the trim member 24 projects radially outward from the distal edge 80 for preventing collected water from cascading downward over the edge 80 of the mating wall. Two end dams 84, 86 project outward from each segment 64, 66, 68, 70 near the corners 65, 67, 69, 71 for preventing the collected water from cascading downward over the corners (e.g. corners 65, 71 as illustrated in the presently selected assembly orientation 50). This trapped water is then diverted through first and second weeping holes 88, 90 that communicating through the facial plate 62 of the trim member 24. Each planar segment 64, 66, 68, 70 is associated with a respective pair of the holes 88, 90.

The width or height of the rear dam, or dam flange 82 is a function of the amount of waterflow that is expected to fall onto the outer wall 30 of the base member 22 from above during rainfall. A wider horizontal section of the outer wall 30 will collect more rainfall and thus require a higher dam flange 82. The rear dam 82 and end dams 84, 86 form a trough on each of the sections 64, 66, 68, 70. The height of the dam flange 82 generally matches the gap or distance 38 between the inner and outer walls 32, 30 of the base member 22. In this way, water cannot escape off of the top of the mating wall 60 except through the weep holes 88, 90.

Since the outer perimeter of the facial plate 62 extends over the top of the siding that is further abutted to the plurality of ribs 74 of the base member 22, water diverted by the ribs 74, through the weep holes 88, 90 and out onto the front surface of the facial plate 62 will drip off of the lower edge of the facial plate and back out onto the surface of the siding where it can continue its downward flow without seepage behind the siding. Regardless of how the installer orientates the assembly 20, water will properly be diverted. Preferably, the weep holes 88, 90 are bound by a rim 98 for preventing water that is flowing down the outward surface of the facial plate 62 from entering into the unused weep holes below.

Figure 8:
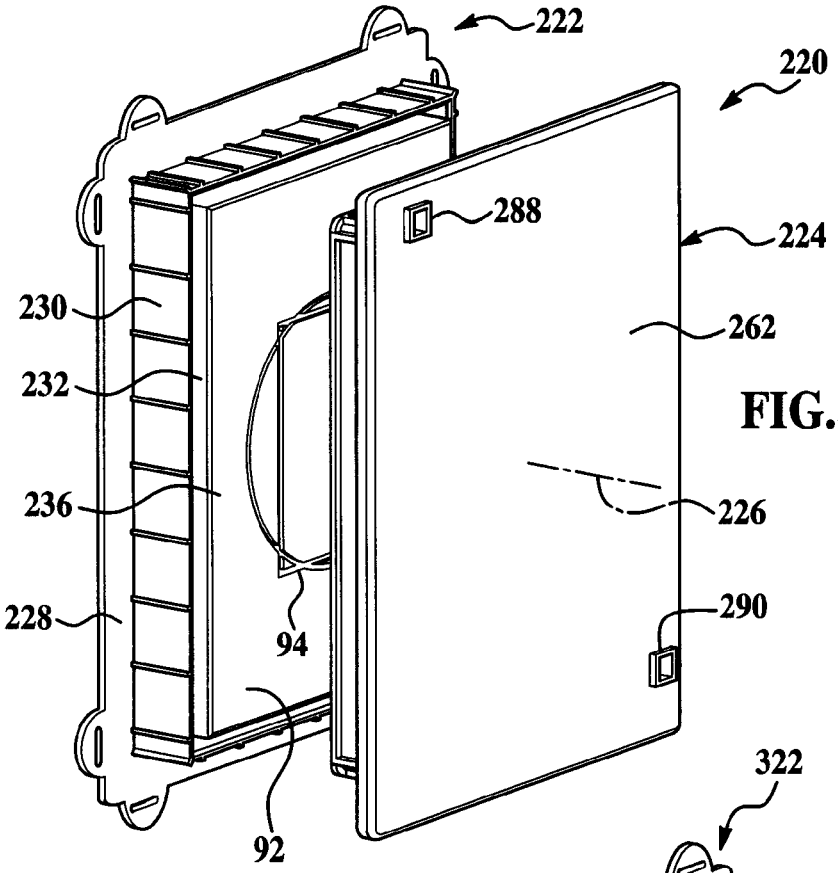
FIG. 8 is an exploded perspective view of a second embodiment of a multidirectional mounting bracket assembly.

Referring to FIG. 8, a second embodiment of a mounting bracket assembly 220 is illustrated wherein similar elements to the first embodiment have similar identifying numerals except with the added suffix of a numeral two. Assembly 220 has a base member 222. Contrary to the first embodiment, the base member 222 has a sub plate 92 that spans radially inward with respect to axis 226 and from a continuous distal edge 236 of an inner wall 232 of the base member 222. This sub plate 92 serves to keep the inner and outer walls 32, 33 in alignment and prevents warping of the inner wall 32 during the manufacturing process. The sub plate 92 may also have a cut-out feature 94 for creating a utility hole when the base member 222 is installed upon a building. Weep holes 288, 290 are preferably placed on opposing sides of the facial plate 262. Because the weep holes are not directly aligned over one another, water flowing out of the top weep hole can not flow into the lower unused weep hole.

Figure 9:
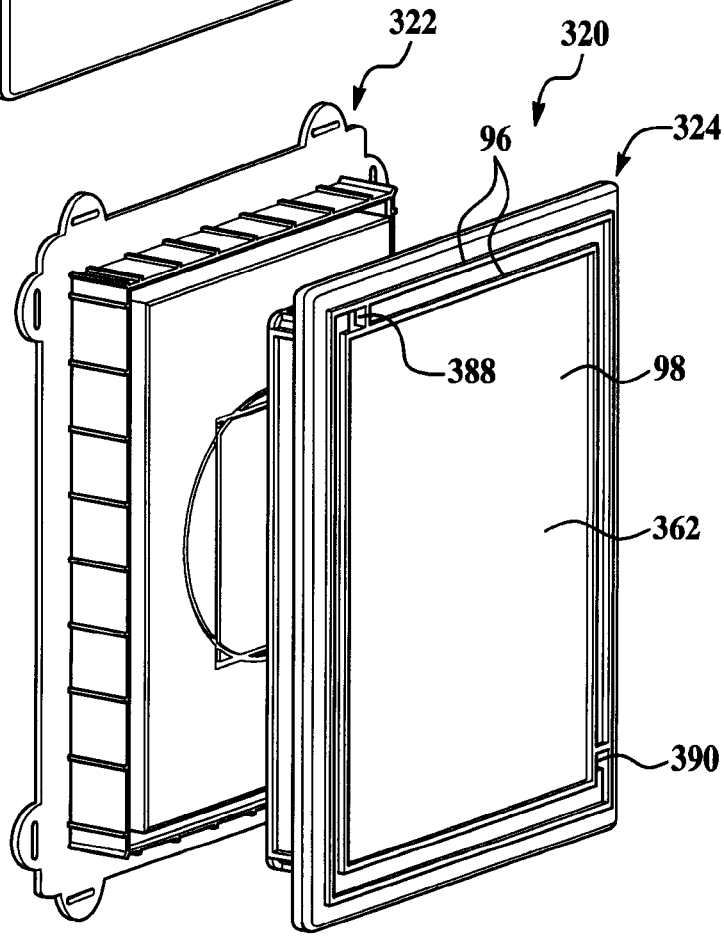
FIG. 9 is an exploded perspective view of a third embodiment of a multidirectional mounting bracket assembly.

Referring to FIG. 9, a third embodiment of a mounting bracket assembly 320 is illustrated wherein similar elements to the first and third embodiments have similar identifying numerals except with the addition of a numeral three suffix. Weeping holes 388, 390 in a face plate 362 of a trim member 324 are generally disguised by an ornamental feature 96 carried by an outward surface 98 of the face plate 362.

While the forms of the invention herein disclosed constitute a presently preferred embodiments, many others are possible. It is not intended herein to mention all the possible equivalent forms or ramification of the invention. It is understood that terms used herein are merely descriptive, rather than limiting, and that various changes may be made without departing from the spirit or scope of the invention.

The invention claimed is:

1. A multidirectional mounting bracket assembly for exterior siding that is secured to a substantially vertical exterior wall of a building, the bracket assembly comprising:

an axis projecting outward from the exterior wall;

a base member having a circumferentially continuous base flange projecting radially outward, a circumferentially continuous outer wall projecting axially outward from the base flange, and a circumferentially continuous inner wall spaced radially inward from and co-axially projecting with the outer wall;

a trim member having a facial plate disposed parallel to the continuous base flange and a circumferentially continuous mating wall projecting axially inward from the facial plate and fitted between the continuous outer and inner walls, the mating wall having a distal edge; and a circumferentially continuous dam flange projecting radially outward from the mating wall for channeling water.

2. The multidirectional mounting bracket assembly set forth in claim 1 further comprising a plurality of channeling features carried by a radially outward facing face of the outer wall, wherein each one of the plurality of channeling features co-extend axially with respect to the axis and are spaced circumferentially from one-another for channeling water outward from the base flange.

3. The multidirectional mounting bracket assembly set forth in claim 1 further comprising:

an annular cavity defined radially between the inner and outer walls wherein the dam flange and the mating wall are in the cavity; and at least one weeping hole extending through the facial plate and communicating with the annular cavity.

4. The multidirectional mounting bracket assembly set forth in claim 1 further comprising:

an annular cavity defined radially between the inner and outer walls wherein the dam flange and the mating wall are in the cavity; and at least one weeping hole extending through the facial plate and communicating with the annular cavity.

5. The multidirectional mounting bracket assembly set forth in claim 1 wherein the inner wall laterally projects axially outward further than the outer wall.

6. The multidirectional mounting bracket assembly set forth in claim 1 further comprising a sub-plate orientated perpendicular to the axis and spanning radially inward from a continuous distal edge of the inner wall.

7. A multidirectional mounting bracket assembly secured to a substantially vertical substructure of a sided exterior wall and orientated substantially vertical and in-part generally projecting over siding that covers the substructure, the multidirectional mounting bracket assembly comprising:

an axis projecting outward from the exterior wall;

a base member having a base flange projecting radially outward, and a circumferentially continuous outer wall projecting axially outward from the base flange;

the outer wall having a plurality of planar sections, wherein each one of the plurality of planar sections project circumferentially to the next adjacent planar section forming a plurality of corners located respectively between adjacent planar sections of the plurality of planar sections;

a trim member having a facial plate disposed parallel to the continuous base flange and a circumferentially continuous mating wall having a distal edge and projecting axially inward from the facial plate and being aligned axially with and disposed radially inward from the outer wall;

the mating wall having a plurality of planar segments, wherein each one of the plurality of planar segments project circumferentially to the next adjacent planar segment forming a plurality of apexes located respectively there between, and wherein each one of the plurality of sections is aligned circumferentially to a respective one of the plurality of segments; and a continuous dam flange laterally projecting radially outward from the distal edge for channeling water.

8. The multidirectional mounting bracket assembly set forth in claim 7 further comprising:

a first end dam located near each first end of each respective plurality of planar segments;

a second end dam located near each opposite second end of each respective plurality of planar segments;

wherein each of the first and second end dams longitudinally extend axially and laterally project radially outward from each respective one of the plurality of planar segments; and a first plurality of weeping holes extending through the facial plate and disposed radially outward from the mating wall; and wherein each one of the plurality of weeping holes is associated with a respective one of the plurality of planar segments.

9. The multidirectional mounting bracket assembly set forth in claim 8 further comprising:

a second plurality of weeping holes extending through the facial plate and disposed radially outward from the mating wall; and wherein each one of the first plurality of weeping holes is located near the first end dam and each one of the second plurality of weeping holes is located near the second end dam associated with each respective one of the plurality of planar segments.

10. The multidirectional mounting bracket assembly set forth in claim 7 further comprising:

each one of the plurality of planar sections having an outer face facing radially outward; and at least one channeling feature defined by the outer face of each one of the plurality of planar sections, wherein the at least one channeling feature longitudinally extends axially.

11. The multidirectional mounting bracket assembly set forth in claim 8 further comprising:

each one of the plurality of planar sections having an outer face facing radially outward; and at least one channeling feature carried by the outer face of each one of the plurality of planar sections, wherein the at least one channeling feature longitudinally extends axially.

12. The multidirectional mounting bracket assembly set forth in claim 11 wherein the at least one channeling feature is a rib laterally projecting radially outward with respect to each one of the plurality of planar sections.

13. The multidirectional mounting bracket assembly set forth in claim 8 wherein the first and second end dams extend axially outward from the continuous dam flange.

14. The multidirectional mounting bracket assembly set forth in claim 8 wherein an outer surface of the facial plate defines an ornamental feature for aesthetically masking the plurality of first weeping holes.

15. A multidirectional mounting bracket assembly secured to a substantially vertical substructure of a sided exterior wall and orientated substantially vertical and in-part generally projecting over siding that covers the substructure, the multidirectional mounting bracket assembly comprising:

an axis projecting outward from the exterior wall;

a base member having a base flange projecting radially outward, and a circumferentially continuous outer wall projecting axially outward from the base flange;

the outer wall having a plurality of planar sections, wherein each one of the plurality of planar sections project circumferentially to the next adjacent planar section forming a plurality of corners located respectively between adjacent planar sections of the plurality of planar sections;

a trim member having a facial plate disposed parallel to the continuous base flange and a circumferentially continuous mating wall projecting axially inward from the facial plate and being aligned axially with and disposed radially inward from the outer wall;

the mating wall having a plurality of planar segments, wherein each one of the plurality of planar segments project circumferentially to the next adjacent planar segment forming a plurality of apexes located respectively there between, and wherein each one of the plurality of sections is aligned circumferentially to a respective one of the plurality of segments;

a first end dam located near each first end of each respective plurality of planar segments and a second end dam located near each opposite second end of each respective plurality of planar segments wherein each of the first and second end dams longitudinally extend axially and laterally project radially outward from each respective one of the plurality of planar segments; and a first plurality of weeping holes extending through the facial plate and disposed radially outward from the mating wall wherein each one of the plurality of weeping holes is associated with a respective one of the plurality of planar segments.

16. The multidirectional mounting bracket assembly set forth in claim 15 further comprising:

a second plurality of weeping holes extending through the facial plate and disposed radially outward from the mating wall; and wherein each one of the first plurality of weeping holes is located near the first end dam and each one of the second plurality of weeping holes is located near the second end dam associated with each respective one of the plurality of planar segments.

17. The multidirectional mounting bracket assembly set forth in claim 15 further comprising:

each one of the plurality of planar sections having an outer face facing radially outward; and at least one channeling feature carried by the outer face of each one of the plurality of planar sections, wherein the at least one channeling feature longitudinally extends axially.

18. The multidirectional mounting bracket assembly set forth in claim 17 wherein the at least one channeling feature is a rib laterally projecting radially outward with respect to each one of the plurality of planar sections.

19. The multidirectional mounting bracket assembly set forth in claim 15 wherein an outer surface of the facial plate defines an ornamental feature for aesthetically masking the plurality of first weeping holes.

* * * * *